US008033822B2

(12) United States Patent
Junkins

(10) Patent No.: US 8,033,822 B2
(45) Date of Patent: Oct. 11, 2011

(54) ARTIFICIAL CAMPFIRE APPARATUS

(75) Inventor: Larry Junkins, Burns, TN (US)

(73) Assignee: Junkins, Junkins & Crow, Inc., Burns, TN (US)

( * ) Notice: Subject to any disclaimer, the term of this patent is extended or adjusted under 35 U.S.C. 154(b) by 1061 days.

(21) Appl. No.: 11/492,348

(22) Filed: Jul. 25, 2006

(65) Prior Publication Data

US 2008/0026335 A1 Jan. 31, 2008

(51) Int. Cl.
*F23Q 9/00* (2006.01)

(52) U.S. Cl. .... 431/125; 126/512; 126/25 R; 126/92 AC

(58) Field of Classification Search ..... 431/125; 126/38, 85 R, 39 R, 41 R, 92 R, 92 AC, 512, 126/519, 211, 214 R
See application file for complete search history.

(56) References Cited

U.S. PATENT DOCUMENTS 1,542,417 A * 6/1925 Scherl ..... 126/85 R
2,538,492 A * 1/1951 Anderson et al. ..... 126/93
3,291,116 A * 12/1966 Brooks ..... 126/92 R
3,616,788 A * 11/1971 Hannebaum ..... 126/549
3,805,762 A * 4/1974 Nelson ..... 126/506
3,815,571 A * 6/1974 Heffelfinger ..... 126/9 R
3,824,984 A * 7/1974 Swanson et al. ..... 126/25 R
4,313,416 A * 2/1982 Lau ..... 126/39 E
4,505,195 A * 3/1985 Waltman ..... 99/427
4,593,613 A * 6/1986 Waltman ..... 99/427
4,779,608 A * 10/1988 Smith ..... 126/512
4,930,490 A * 6/1990 Allan ..... 126/92 R
5,094,223 A 3/1992 Gonzalez ..... 126/25
5,197,455 A * 3/1993 Tessien ..... 126/25 B
5,313,928 A * 5/1994 Rodgers et al. ..... 126/38
5,803,727 A * 9/1998 Long ..... 431/247
5,868,128 A * 2/1999 Omar ..... 126/512
5,890,485 A * 4/1999 Shimek et al. ..... 126/512
5,901,697 A 5/1999 Oliver, Jr. et al. ..... 126/92
6,006,743 A * 12/1999 Shimek et al. ..... 126/512
6,044,836 A * 4/2000 Oliver et al. ..... 126/92 AC
6,142,143 A * 11/2000 Martin ..... 126/506
6,227,843 B1 5/2001 Pedersen et al. ..... 431/125
6,261,087 B1 * 7/2001 Bird et al. ..... 431/80
6,267,113 B1 * 7/2001 Maust et al. ..... 126/512
6,289,887 B1 * 9/2001 Oliver et al. ..... 126/92 AC
6,354,288 B1 * 3/2002 McDonald ..... 126/519
6,488,025 B1 * 12/2002 Cunningham ..... 126/92 AC
6,508,245 B2 * 1/2003 Taplan ..... 126/39 R
6,606,987 B2 * 8/2003 DeMars ..... 126/38
6,957,649 B1 * 10/2005 Bourgeois ..... 126/40
6,978,777 B2 * 12/2005 Pestrue et al. ..... 126/25 R
7,047,963 B2 5/2006 Van Vleet ..... 126/512
7,438,071 B2 * 10/2008 Johnson et al. ..... 126/25 R
7,479,008 B2 * 1/2009 Thomas ..... 431/352
7,607,426 B2 * 10/2009 Deng ..... 126/116 A
2002/0185122 A1 * 12/2002 Bossler ..... 126/519

(Continued)

*Primary Examiner* — Steven B McAllister
*Assistant Examiner* — Desmond Peyton
(74) *Attorney, Agent, or Firm* — Wadddey & Patterson, P.C.; Emily A. Shouse; Matthew C. Cox

(57) ABSTRACT

A portable, self-contained artificial campfire apparatus is disclosed. The apparatus comprises a base container which can house an internal fuel source, a removable lid for accessing the container base, a fiber-ceramic log assembly connected to the removable lid, and a second lid for protecting and transporting the apparatus. The use of fiber-ceramic artificial logs allows for a more realistic campfire because the logs will glow as they are heated, just as a wood campfire does. The artificial campfire preferably also includes a tapered burner unit to produce an even more realistic campfire appearance.

12 Claims, 5 Drawing Sheets

U.S. PATENT DOCUMENTS

2003/0188735 A1* 10/2003 Yang ..... 126/519
2004/0031479 A1* 2/2004 Davis ..... 126/39 R
2005/0274372 A1* 12/2005 Knight ..... 126/9 R
2006/0072307 A1 4/2006 Jozefowicz
2007/0224560 A1* 9/2007 Stainrod et al. ..... 431/125
2007/0277803 A1* 12/2007 Deng ..... 126/92 AC

* cited by examiner

ARTIFICIAL CAMPFIRE APPARATUS

BACKGROUND OF THE INVENTION

The present invention relates generally to an artificial campfire apparatus. More particularly, it pertains to light ceramic gas logs, having a tapered burner unit, connected to a container base to create a realistic, self-contained, and portable artificial campfire.

Camping is an activity enjoyed by roughly fifty million Americans every year. A traditional part of the camping experience is the campfire. For some campers the campfire provides a means for cooking food. However, with the availability of small cooking devices that can be easily carried in a backpack, as well as the availability of grills at campgrounds, there is less need for a campfire as a means to cook food. Therefore, many of the campers who continue to start campfires do so primarily to enjoy the light and warmth that a campfire provides. Unfortunately, with a large number of campers in the United States and unpredictable weather conditions, the outdoor wood campfire is sometimes inconvenient and at other times not allowed.

One problem with wood campfires is that they can be difficult to start. With the large number of campers in the United States it can sometimes be difficult to find fallen wood to fuel the campfire. A lack of fallen wood at campgrounds makes starting and maintaining a campfire problematic requiring campers who want a wood campfire to travel with their firewood. This can be burdensome because of the amount of wood that can be required on a nightly basis. Additionally, if it has rained recently it will be difficult for the campers to find dry firewood to fuel their fire. Without dry wood, a camper will be left with a smokey fire that does not produce much heat and is not aesthetically pleasing. Therefore, while the wood campfire can be a source of great pleasure for campers it can just as easily be a source of frustration.

Another problem with a wood campfire is that there are times when wood fires are prohibited. This is particularly true during droughts when burning bans are in effect. Burning bans are enacted as an effort to reduce the number of wildfires started each year by hot embers and out of control campfires. While these bans are in effect, campers are not allowed to burn wood fires but can usually still have contained artificial fires. Therefore, there are times when a wood fire is not even an option for campers and they desire an alternative to complete their camping experience, such as portable artificial campfire.

There are various artificial campfire devices in the prior art. Many of these devices utilize artificial refractory logs which heat very well, but they do not obtain the glow of a wood campfire. Additionally, many of the prior art references require placing the logs within a container, reducing the aesthetic appeal of the artificial campfire. Finally, the prior art references utilize a circular, single level burner unit which does not produce a natural looking fire as evidenced by the prior art use of materials to alter the appearance of the fire created by the burner units.

What is needed, then, is a portable artificial campfire which creates a natural looking flame and obtains the aesthetic glow of a natural campfire.

BRIEF SUMMARY OF THE INVENTION

A portable artificial campfire apparatus is disclosed. In one embodiment of the invention the apparatus has a base container, a lid pivotally connected to the container, and an artificial log assembly connected to the lid. In another embodiment of the invention the apparatus has a base container, a removable lid, a tapered burn unit connected to the lid and artificial logs placed around the burner unit.

It is one object of the invention to provide a portable, self-contained artificial campfire.

It is another object of the invention to provide a campfire that creates a more natural looking campfire similar to that created by a wood fire.

DETAILED DESCRIPTION OF THE INVENTION

Figure 1:
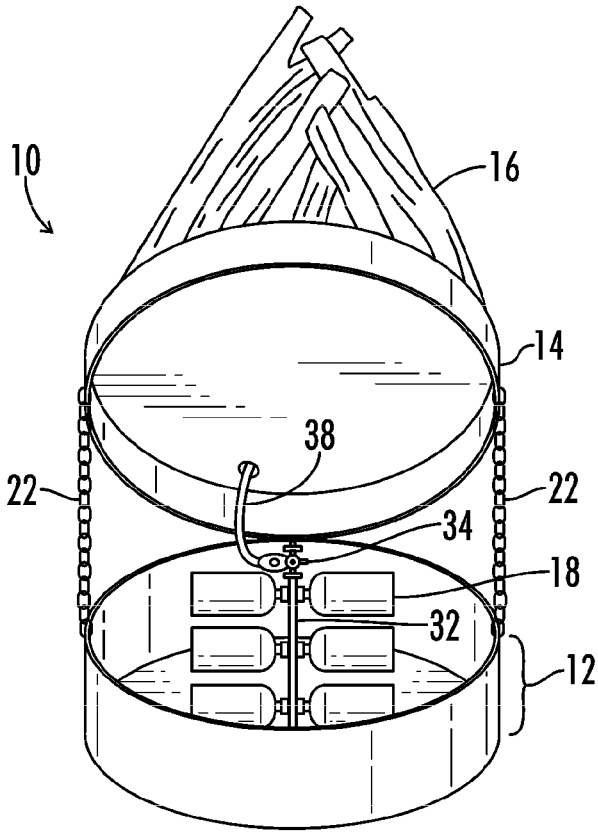
FIG. 1 is a front view of the apparatus with the first lid open.

Referring now to the drawings and particularly to FIG. 1, an artificial campfire apparatus of the present invention is shown and generally designated by the numeral 10. FIG. 1 shows the artificial campfire apparatus 10 of the present invention comprising a base container 12, a first lid 14 pivotally connected to the base container 12, and an artificial log assembly 16 connected to the first lid 14.

The base container 12, as shown in FIG. 1, is cylindrically shaped. However, the base container 12 can be any shape desired, limited only by the articles that are to be stored within the base container 12. The height of the base container 12 is also dependent on the articles that are to be stored within the base container 12, because the larger the items that are to be stored, the taller the base container 12 must be.

In FIG. 1, propane canisters 18 are shown stored inside of the base container 12. By making the base container 12 large enough to store propane canisters 18, but not significantly larger, the artificial campfire can be self contained, not requiring an external fuel source and still be easily portable. Thus, by creating a portable, self-contained artificial campfire apparatus, one object of the present invention is achieved.

Figure 3:
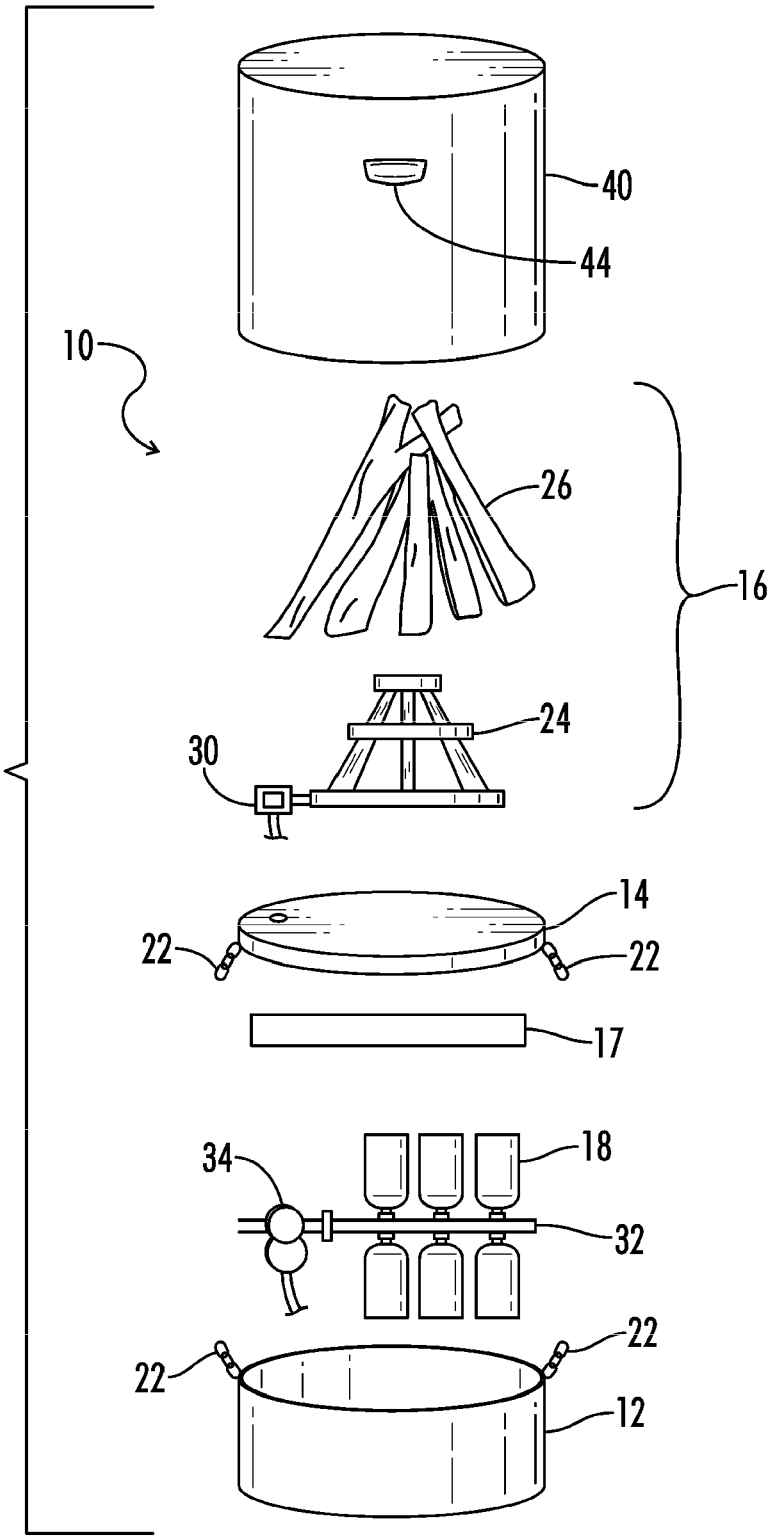
FIG. 3 is a side exploded view of the apparatus.

FIG. 3 also shows insulation 17 installed on the inside of the first lid 14. The insulation 17 is placed in the first lid 14 to reduce the heat transferred from the artificial log assembly 16, to the contents of the base container 12. Reducing the heat transferred to the contents of the base container 12, it is safer to store propane canisters 18 in the base container 12.

Figure 2:
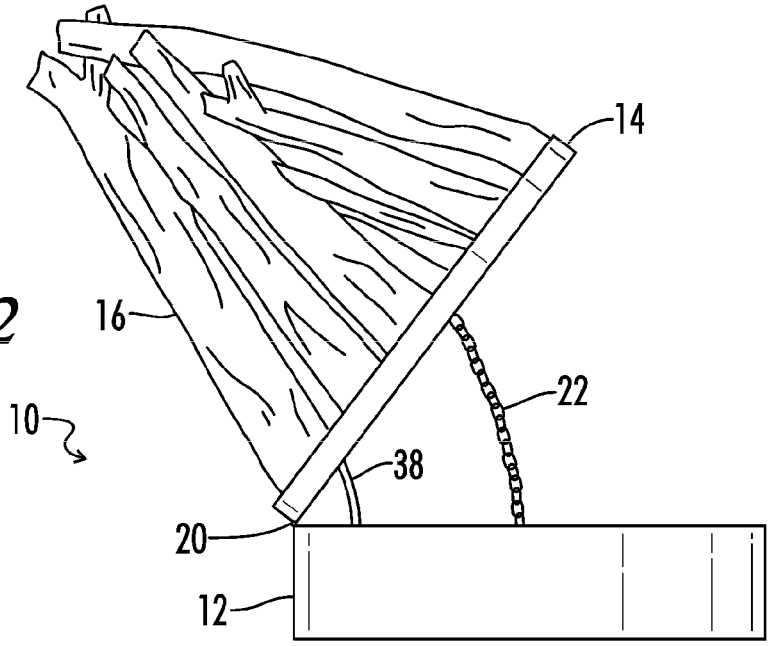
FIG. 2 is a side exterior view of the apparatus with the first lid open.

Now referring to FIG. 2, the first lid 14 is shown pivotally connected to the base container 12 by a hinge 20. By pivotally connecting the first lid 14 to the base container 12, it is easy to access the inside of the base container 12. This allows a user to easily replace propane canisters 18 that are stored within the base container 12 without being required to completely remove the first lid 14. Similarly, if other articles were to be stored within the base container 12 they could just as easily be accessed through the use of a pivotal connection.

A pivotally connected first lid 14 is much easier to open than a lid that requires removal from the container base 12, because much of the weight of the first lid 14 remains supported by the base container 12 when using a pivotal connection. Thus, by pivotally connecting the first lid 14 to the base container 12, the artificial campfire 10 is less frustrating to use because it requires less effort, thereby addressing one of the problems with a traditional campfire.

Still referring to FIG. 2, the artificial log assembly 16 is shown connected to the first lid 14. By connecting the artificial log assembly 16 to the first lid 14, the first lid 14 can be opened without removing the artificial log assembly 16. This allows for easier use of the artificial campfire 10, thus making use of the artificial campfire 10 even less frustrating.

Further, by connecting the artificial log assembly 16 to the first lid 14 the desired configuration of the artificial log assembly 16 will be maintained throughout movement of the first lid 14. The artificial log assembly 16 can be connected to the first lid 14 in any manner that will prevent the artificial log assembly from falling or shifting when the first lid 14 is pivotally rotated to access the inside of the base container 12.

The configuration of the artificial log assembly 16 shown in FIG. 2 is a teepee shaped configuration, which is the shape that many people think of when they picture a campfire. However, the configuration of the artificial log assembly 16 can take many forms and the size of the artificial log assembly 16 can also vary as desired by consumers.

To prevent the first lid 14 from pivoting beyond a desired angle, a restraining device 22 is connected between the first lid 14 and the base container 12. FIG. 2 shows the restraining device 22 comprising a chain connected between the first lid 14 and the base container 12. However, any device that would prevent further radial movement of the first lid 14 beyond a desired angle can be used.

If a restraining device were not used to prevent pivotal motion beyond a desired angle, the first lid 14 could rotate pivotally until the artificial log assembly 16 came into contact with the ground. This contact with the ground could be forceful enough to result in damage to the artificial log assembly 16. Thus, a restraining device 22 can prevent damage to the artificial log assembly 16, reducing potential frustration of operating the artificial campfire 10.

Instead of pivotally connecting the first lid 14 to the container base 12, the first lid 14 could be removable. This would still allow access to the container base 12, but would require the user to lift the artificial log assembly 16 and the first lid 14 from the container base 12. A lifting device can be utilized to eliminate the need for the user to lift the lid themselves.

Now referring to FIG. 3, the artificial log assembly 16 is shown comprising a burner unit 24 and a plurality of artificial logs 26. The artificial logs 26 are preferably fiber-ceramic logs because as fiber-ceramic logs are heated they will begin to glow, just as a natural campfire glows. This glow adds to the aesthetic appeal of the artificial campfire 10 and helps satisfy one of the objects of the invention. However, there may be situations where a different artificial log material is desired, due to the beneficial characteristics of the particular material. Therefore, alternative artificial log materials can be used.

The artificial logs 26, as shown in FIG. 3, are in a teepee configuration. Many people think of the teepee configuration when they picture a wood campfire. Thus, the advantage of using a teepee shape as shown in FIG. 3 is that it resembles at least the mental image of a realistic campfire. Therefore, the teepee configuration further helps satisfy the emotional and mental desire campers have for a campfire. However, it should be understood that any configuration of artificial logs 26 can be used as desired by consumers.

The burner unit 24, as shown in FIG. 3, is conically shaped. By using a conically shaped burner unit 24, when teepee configured artificial logs 26 are placed about the burner unit 24, fire will be emitted at multiple points along the teepee configured artificial logs 26. Having fire emitted at multiple points along the surface of the artificial logs 26 creates a more realistic campfire. Thus, by utilizing a conically shaped burner unit 24 in conjunction with teepee configured artificial logs 26, the camper is further satisfied with their campfire experience.

Figure 4:
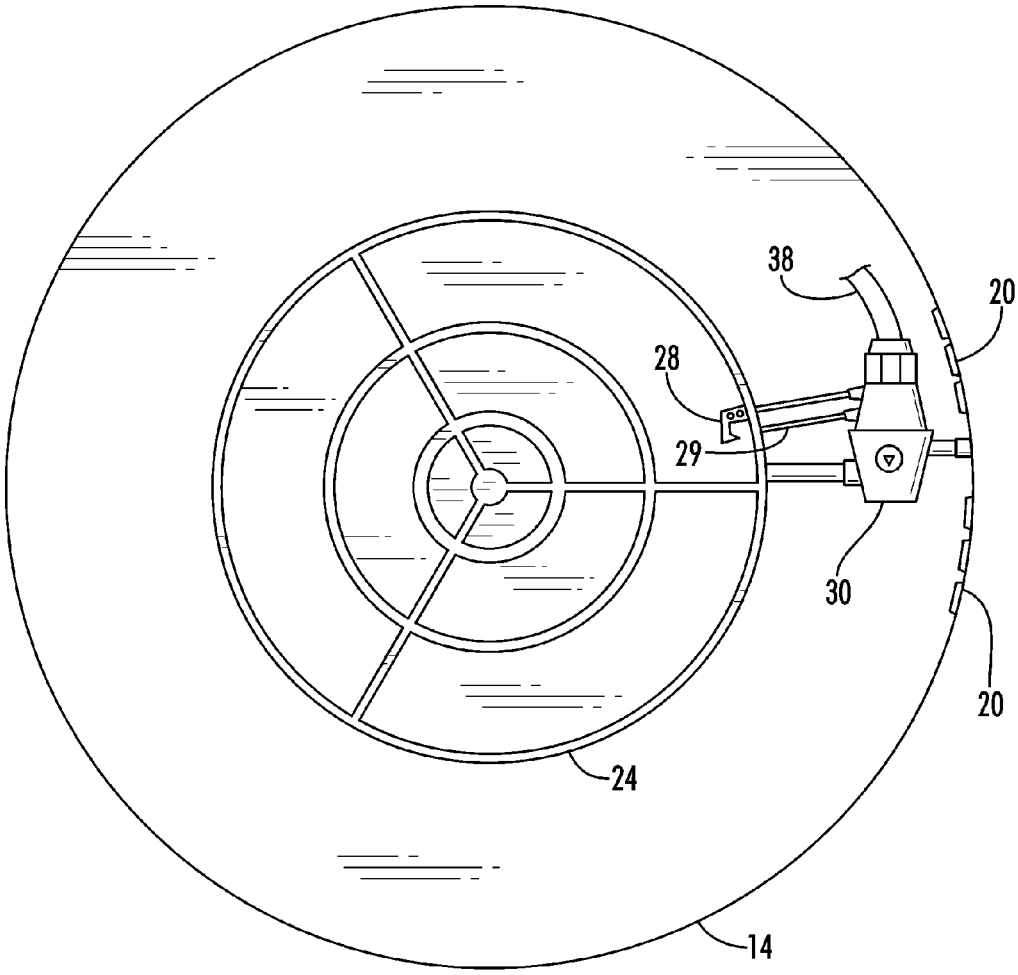
FIG. 4 is a top view of the container base with the first lid installed and the tapered burner unit installed.

Now referring to FIG. 4, a top view of a conically shaped burner unit 24 is shown installed on the first lid 14. This view shows that the burner rings on a conically shaped burner unit 24 are larger in diameter at the base of the burner unit 24 and smaller in diameter toward the top of the unit. Further, this view shows that the burner unit 24 is centered on the first lid 14 and that surface area remains on the first lid 14 for receiving the artificial logs 26. The surface area on the first lid 14 required for receiving the artificial logs 26 is dependent on the size of the artificial logs 26 that are used. Typically, the artificial logs 26 and the burner unit 24 will be paired such that the diameter of the artificial log assembly 16 will be known and can be matched to the diameter of the first lid 14.

Still referring to FIG. 4, a pilot light 28 is shown installed on the outermost ring of the burner unit 24 as well as a cutoff valve 30 which is connected between a fuel source and the burner unit 24. By installing the pilot light 28 and the cutoff valve 30 it will be easier to light a fire when one is desired. Once the pilot light 28 has been lit, the user can simply adjust the propane flow to the burner unit 24 by adjusting the cutoff valve 30. The inclusion of a pilot light 28 and a cutoff valve 30 helps create an easy to use artificial campfire 10, and thus reduces any frustration associated with lighting the artificial campfire 10.

Additionally, FIG. 4 shows a thermocoupler 29 installed adjacent to the pilot light 28. The thermocoupler 29 is included as a safety device and is positioned such that a flame from the pilot light 28 will engage the thermocoupler 29. When the thermocoupler 29 is cold, the cutoff valve 30 will remain closed, not allowing any gas to reach the burner unit 24. Similarly, gas also will not reach the pilot light 28 unless the thermocoupler 29 is manually bypassed, as is done when lighting the pilot light. Once the flame from the pilot light 28 has heated the thermocoupler 29, it will allow gas to flow through the cutoff valve 30 to the burner unit 24 and pilot light 28. Thus, if the flame of the pilot light 28 is extinguished, gas flow to both the burner unit 24 and the pilot light 28 will cease, keeping the user and surrounding area safer.

To further simplify control of the burner unit 24, a controller (not shown) can be provided to allow the burner unit 24 to be controlled remotely. By allowing remote control of the burner unit 24 the user can remain a safe distance from the artificial campfire 10 while igniting it, as well as completely controlling the size of the flames and even extinguishing the fire remotely. This allows the user to completely enjoy the campfire experience with the simple push of a button.

Figure 5:
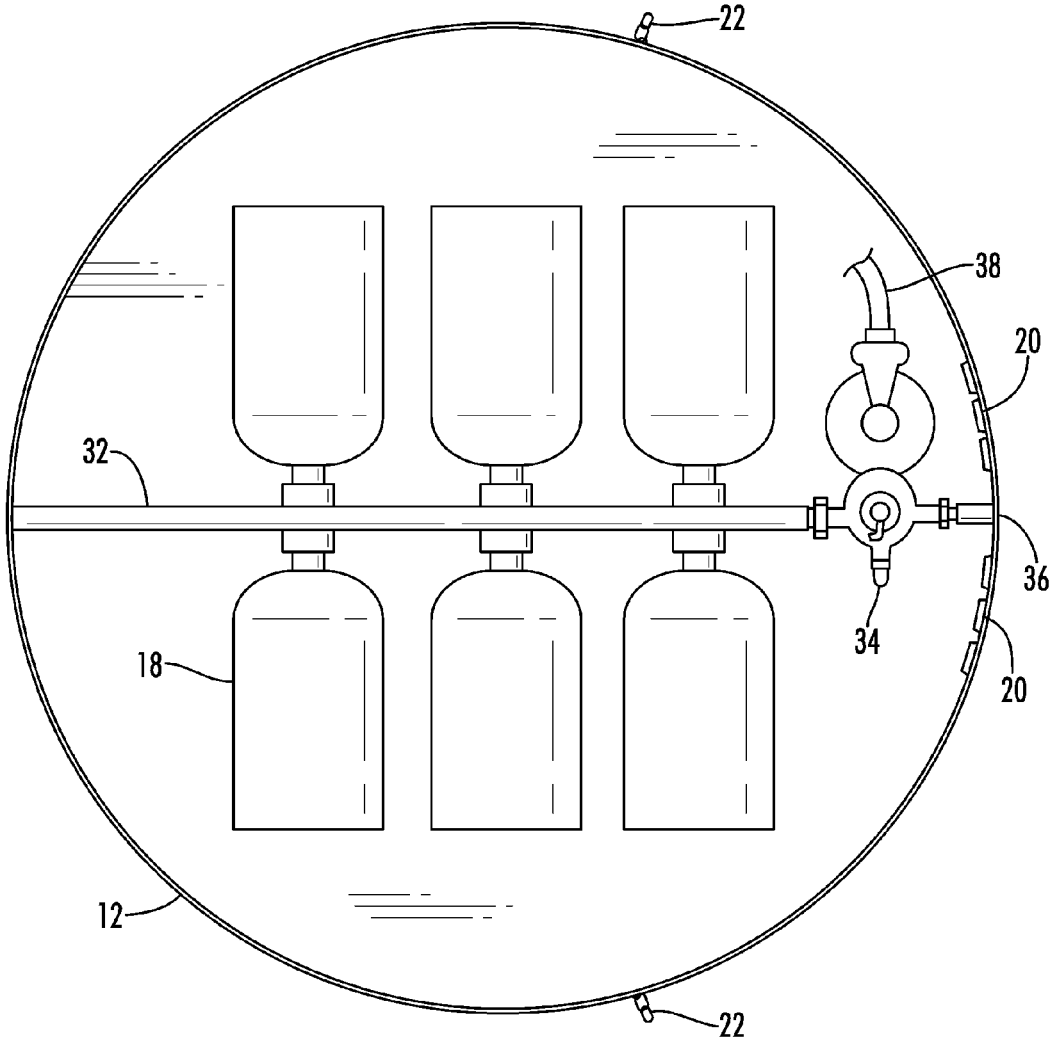
FIG. 5 is a top view of the container base with the first lid removed.

Now referring to FIG. 5, a detailed view of the interior of the container base 12 is shown. Propane canisters 18 are shown installed within the base container 12. Six propane canisters 18 are shown installed in this view, however, the number of propane canisters 18 installed in the base container 12 is only limited by the size of the base container 12. Therefore, if a longer burn time is desired a larger base container 12 can be provided and more propane canisters 18 can be installed.

Alternatively, instead of allowing for small propane canisters 18 to be connected within the base container 12, a permanent fuel container (not shown) can be installed. By installing a permanent fuel container within the base container 12, the user could then refill the fuel container at a propane refilling site. Again, by installing either propane canisters 18 or a permanent fuel container within the base container 12, the need for an external fuel source is reduced or eliminated. Thus, the artificial campfire apparatus 10 is self contained making it easier to transport and operate.

FIG. 5 further shows the propane canisters 18 connected to a first supply line 32. The actual method of connecting the propane canisters 18 to the first supply line 32 is not critical, except that the connection needs to be sealed so that propane does not leak into the base container 12. The first supply line 32 is closed at one end, and connects to a regulator 34 at the other end. This causes the propane to flow toward the regulator 34, when the propane canister 18 is opened.

The regulator 34 shown in FIG. 5 is preferably a two-way regulator. By using a two-way regulator 34, an external fuel connection point 36 can also be connected to the two-way regulator 34. Thus, by providing an external fuel connection point 36, users who desire a longer burn time can utilize an external fuel source without accessing the inside of the base container 12. This allows for more flexibility when using the artificial campfire apparatus 10 because it can be used both in situations where a user requires a self contained device as well as in situations where the user desires a longer burn time.

Still referring to FIG. 5, the regulator 34 has an output that connects to a second supply line 38. The second supply line 38 connects at the other end to the cut off valve 30 as shown in FIG. 4 and facilitates the transport of propane to the cutoff valve 30. FIG. 1 illustrates that the second supply line 38 can travel through a hole defined within the first lid 14 to connect to the cut off valve 30. When this configuration is chosen, the second supply line 38 can be a flexible tubing so that excess stress is not placed on any of the components when the first lid 14 is opened.

Figure 6:
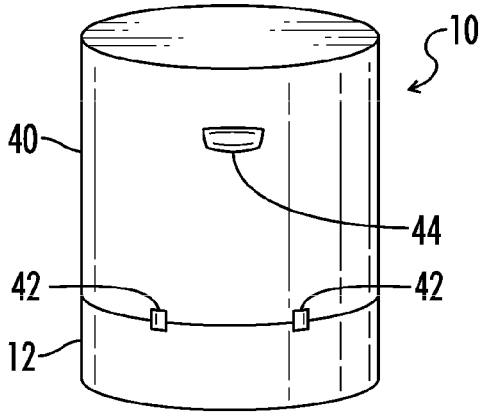
FIG. 6 is a side exterior view of the apparatus with the second lid secured to the container base.

Now referring to FIG. 6, a second lid 40 can be provided with the artificial campfire apparatus 10. FIG. 6 shows the second lid 40 placed over the artificial log assembly 16 and engaging the base container 12. The second lid 40 is utilized to ease in transport of the artificial campfire apparatus 10 as well as to protect the artificial log assembly 16. The size of the second lid 40 is dependent on the diameter of the base container 12 and the height of the artificial log assembly 16 as the second lid 40 must mate with the base container 12 and completely house the artificial log assembly 16.

The second lid 40 is secured to the base container 12 by securements 42. The securements 42 are preferably snap attachments; however, it should be appreciated that any device that secures second lid 40 to base container 12 can be used. The primary limitation, on the selection of securements 42 used, is that they must be strong enough to withstand the force placed on them when the artificial campfire 10 is lifted by the second lid 40.

FIG. 6 also illustrates handle impressions 44 defined within the second lid 40. The handle impressions 44 are utilized both when transporting the artificial campfire apparatus 10 as well as when removing the second lid 40. While FIG. 6 shows handle impressions 44 defined within the second lid 40, other handle solutions can be used such as attaching handles to the outside of the second lid 40. By including handles or handle impressions 44 on the second lid 40 it is easier to transport the artificial campfire 10, thereby making it more convenient and more portable.

Figure 7A:
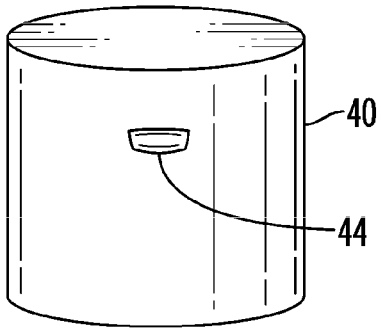
FIG. 7A is a side exterior view of the second lid removed from the container base.
Figure 7B:
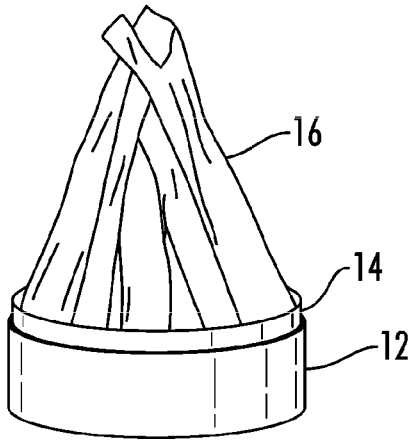
FIG. 7B is a side exterior view of the apparatus with the second lid removed from the container base.

Now referring to FIGS. 7A and 7B, FIG. 7A shows the second lid 40 removed from the base container 12, while FIG. 7B shows the artificial campfire 10 with the second lid 40 removed, exposing the artificial log assembly 16 and the first lid 14 on top of the base container 12.

Thus, it is seen that the apparatus of the present invention readily achieves the ends and advantages mentioned as well as those inherent therein. While certain preferred embodiments of the invention have been illustrated and described for purposes of the present disclosure, numerous changes in the arrangement and construction thereof may be made by those skilled in the art, which changes are encompassed within the scope of the present invention as defined by the appended claims.

What is claimed is:

1. An artificial campfire apparatus comprising:

a base container having a rounded shape and including a continuous bottom surface and side walls extending upward from the bottom surface, the base container including a base container diameter;

a first lid pivotally connected to said base container, the first lid including a hole defined therein:

a fuel line extending from the base container through the hole defined in the first lid;

an artificial log assembly connected to said first lid;

a hinge pivotally connecting a first side of the first lid to the base container, the hinge positioned along the outer circumference of the base container such that in an open position the first side of the first lid remains adjacent the base container and a second side of the first lid opposite the first side is farther away from the base container; and a restraining device for limiting pivotal motion of said first lid relative to said base container; wherein the first lid substantially covers the base container in a closed position.

2. The artificial campfire apparatus of claim 1, wherein the restraining device comprises a chain.

3. The artificial campfire apparatus of claim 1 further comprising:

a second lid for covering said log assembly when the apparatus is not in use; and a securement for securing said second lid to said base container, wherein the second lid completely houses the artificial log assembly when installed on the base container, the second lid having substantially the same diameter as the base container such that the second lid and base container form a cylinder with closed ends when the second lid is installed on the base container.

4. The artificial campfire apparatus of claim 3, wherein the second lid comprises handle impressions defined therein for carrying the apparatus.

5. The artificial campfire apparatus of claim 1 further comprising a controller for remotely controlling lighting the artificial log assembly.

6. The artificial campfire apparatus of claim 1, wherein the artificial log assembly comprises:

a burner unit; and a fiber-ceramic log received about said burner unit.

7. An artificial campfire apparatus comprising:

a base container;

a removable first lid for covering said base container, the first lid pivotally attached to said base container, the first lid substantially covering the base container when positioned on the base container;

a burner unit attached to the fuel hose, the burner unit further comprising:

a first ring-shaped burner having a first burner ring diameter, and a second ring-shaped burner having a second burner ring diameter, wherein the second burner ring diameter is smaller than the first burner ring diameter and the second ring-shaped burner is positioned above the first ring-shaped burner; and a plurality of artificial logs received about said burner unit;

wherein first and second ring-shaped burners are positioned between the first lid and the plurality of artificial logs.

8. The artificial campfire apparatus of claim 7, wherein the artificial logs are fiber-ceramic.

9. The artificial campfire apparatus of claim 7 further comprising:

a removable second lid for covering said artificial logs when the apparatus is not in use; and a securement for securing said second lid to said base container.

10. The artificial campfire apparatus of claim 9, wherein the second lid comprises handle impressions defined therein for carrying the apparatus.

11. The artificial campfire apparatus of claim 7 further comprising a controller for remotely controlling said burner.

12. An artificial campfire apparatus, comprising:

a substantially cylindrical base container;

a fuel supply line disposed in the base container, the fuel supply line including a regulator;

a first lid disposed over the base container, the first lid being pivotally attached to the base container, the first lid defining a lid hole;

an insulation layer positioned between the first lid and the base container;

a fuel hose attached to the regulator, the fuel hose extending upward through the lid hole in a direction generally away from the base container;

a burner unit attached to the fuel hose, the burner unit further comprising:

a first ring-shaped burner having a first burner ring diameter, and a second ring-shaped burner having a second burner ring diameter, wherein the second burner ring diameter is smaller than the first burner ring diameter and the second ring-shaped burner is positioned above the first ring-shaped burner;

a cutoff valve disposed between the regulator and the burner unit;

an artificial log assembly attached to the burner unit; and a substantially cylindrical second lid disposed over the first lid, wherein the second lid is operable to mate with the base container, the artificial log assembly being completely housed within the second lid when the second lid is mated with the base container.

* * * * *